United States Patent [19]

Hella et al.

[11] Patent Number: 4,837,946

[45] Date of Patent: Jun. 13, 1989

[54] APPARATUS FOR FLOATINGLY SUSPENDING A RUNNING WEB THROUGH AN ARCUATE PATH

[75] Inventors: Jerry A. Hella; Paul H. Stibbe, both of DePere, Wis.

[73] Assignee: Advance Systems, Inc., Oneida, Wis.

[21] Appl. No.: 165,746

[22] Filed: Mar. 9, 1988

[51] Int. Cl.[4] ..... F26B 13/00

[52] U.S. Cl. ..... 34/156; 226/97

[58] Field of Search ..... 34/10, 117, 120, 155, 34/156, 160; 226/7, 97

[56] References Cited

U.S. PATENT DOCUMENTS

| | | | |
|---|---|---|---|
| 3,279,091 | 10/1966 | Freuler | 34/156 |
| 4,197,972 | 4/1980 | Daane | 34/156 X |
| 4,218,833 | 8/1980 | Coar | 34/156 |
| 4,768,695 | 9/1988 | Stibbe . | |
| 4,785,986 | 11/1988 | Daane et al. . | |
| 4,787,547 | 11/1988 | Hella et al. . | |

*Primary Examiner*—Henry A. Bennet

*Attorney, Agent, or Firm*—James E. Nilles

[57] ABSTRACT

Apparatus for floatingly suspending a running web without contact and through an arcuate path and including a series of parallel air bars arranged in an arcuate array for discharging pressurized air outwardly therefrom. Either the first or the last air bars, or both air bars, (in respect to the direction of web travel) may be tilted about their longitudinal axis to correct any non-symmetrical web-to-air bar orientation and to provide more stable pressure profile for the air cushion in a symmetrical web flow pattern. A line of equipment for processing a running web and including (1) a preliminary web treating machine from which the web exits selectively at two different locations and thus at two different angles; (2) apparatus for floatingly suspending the running web through an arcuate path; and (3) a floater dryer located at the discharge end of the turning apparatus; thus, the arcutate array of air bars can accommodate different web paths as the web exits from the web treating machine.

10 Claims, 8 Drawing Sheets

APPARATUS FOR FLOATINGLY SUSPENDING A RUNNING WEB THROUGH AN ARCUATE PATH

BACKGROUND OF THE INVENTION

1. Field of the Invention

The present invention pertains to apparatus for transporting and floating a running web on a cushion of air and without contact.

2. Description of the Prior Art

Examples of the prior art are shown in U.S. Pat. No. 4,218,833, entitled "Float Treatment Apparatus", which issued Aug. 26, 1980 and in which the web is guided around a fixed arcuate path of travel; and the Beggs et al patent U.S. Pat. No. 3,328,997 which issued July 4, 1967 and in which a strip of metal is supported in arcuate and fixed paths.

SUMMARY OF THE INVENTION

The present invention provides apparatus for floatingly suspending and transporting a running web without contact and through an arcuate path, and including a series of elongated air bars having nozzle slots along their length, and which bars are arranged in an arcuate array so as to direct pressurized air in an outwardly direction from the array and for supporting the running web which passes around the array without contact. The invention includes means for tilting the first and/or last air bar, in respect to the direction of air travel, about their longitudinal axis so as to change the angle of attack of the pressurized air issued from the air bar and provide a more stable cushion pressure profile and a more symmetrical web flow pattern. By correcting any nonsymmetrical web-to-air orientation, touching of the air bars by the web is precluded. The invention contemplates tilting either the first or last air bar, or both the first and last air bar in respect to the direction of web travel. A more specific aspect of the invention provides a generally hollow and enclosed chamber having an arcuate side with a series of elongated, generally parallel air bars around its arcuate side. The chamber can be divided into two separate compartments so as to accommodate different web paths, that is, different degrees of wrap of the web around the array and thus utilize fewer than the total number of the air bars in the array for supporting the web.

The invention contemplates the use of such an air bar array in a processing line of equipment wherein the web exits selectively in different directions from a processing machine and before entry into the arcuate array of air bars, and thereby the air bar array can accommodate webs having different degrees of wrap around the array before the web passes to a subsequent web treating machine such as a web dryer.

These and other objects and advantages of the present invention will appear hereinafter as this disclosure progresses, reference being had to the accompanying drawings.

DESCRIPTION OF THE PREFERRED EMBODIMENT

Figure 1:
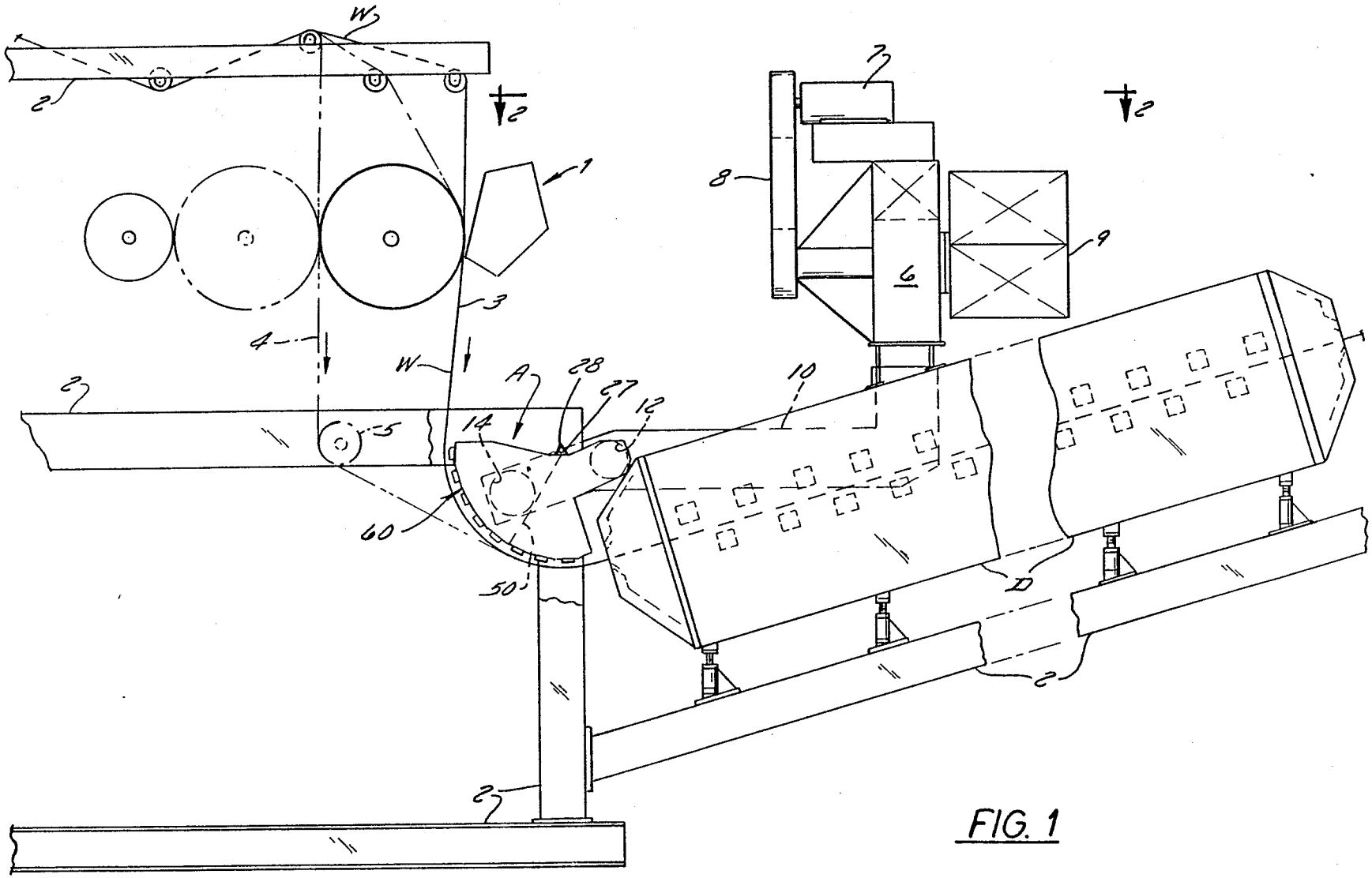
FIG. 1 is a side elevational view, more or less schematic in form, and showing the present invention when used in the environment of a running web processing line of equipment and wherein the web exits selectively from different locations in a web treating machine and before entering the apparatus for turning the web through an arcuate path.

The general arrangement of the environment in which the present invention finds particular utility is shown in FIG. 1 and includes a web treating machine 1 mounted on a steel fabricated frame 2 and from which the web W selectively exits either in paths 3 or 4. The direction of web exit is generally downwardly and in conjunction with path 3 it is preferably at an angle of 7° from the vertical when the machine is a Bill-Blade coater, for example. The web then passes around the apparatus A for floatingly suspending the running web without contact and the apparatus guides the web through an arcuate path, which path may vary as to its degree of wrap around the apparatus A. Upon leaving the apparatus A, the web W passes through a floater dryer D which may be of the type shown in U.S. application Ser. No. 61,329, filed June 11, 1987, which issued an Sept. 6, 1988 as U.S. Pat. No. 4,768,695 and assigned to an assignee common with the present application.

In the present installation shown in FIG. 1, the floater dryer D is positioned at an incline of 15° from the horizontal. In this installation, the web path 3 (as shown by the solid line) must be turned a total of 112° from when it leaves the coater 1 and until it enters the dryer D. When the web path 4 is utilized (the broken line of FIG. 1), the web is turned about 43° after it leaves the last roller 5 before entering the dryer D. Thus, the web may be trained around the apparatus A in different degrees of angular wrap.

Figure 2:
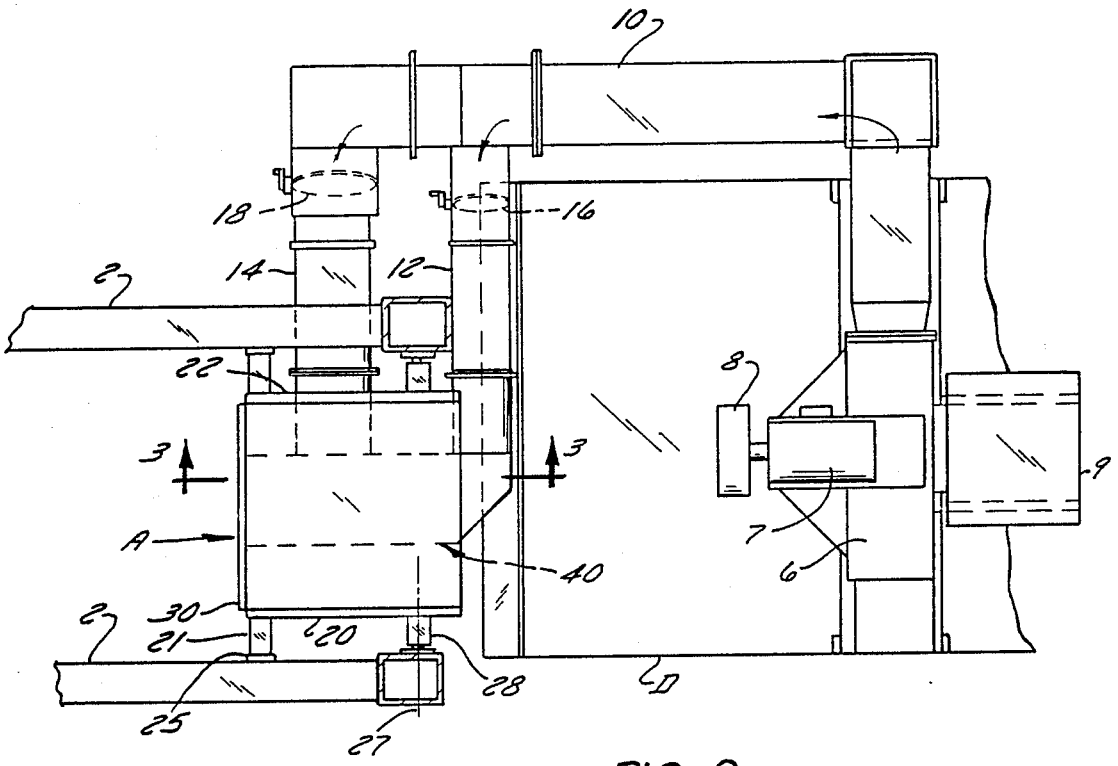
FIG. 2 is a fragmentary plan view of the device shown in FIG. 1 and taken along line 2—2 therein.

Means for providing pressurized air to the apparatus A takes the form of an air fan or blower 6 driven by an electric motor 7 through endless drive means 8 of conventional character. Air is received by the fan inlet from the duct means 9 and is discharged from the fan through the duct 10 and to the apparatus A. As shown in FIG. 2, the main air duct 10 is then split into two separate ducts 12 and 14, each having, respectively, a valve 16, 18 which can be selectively opened or closed. As will appear, if all of the air bars to be described of apparatus A are to be utilized, both valves 16 and 18 are open.

Figure 5:
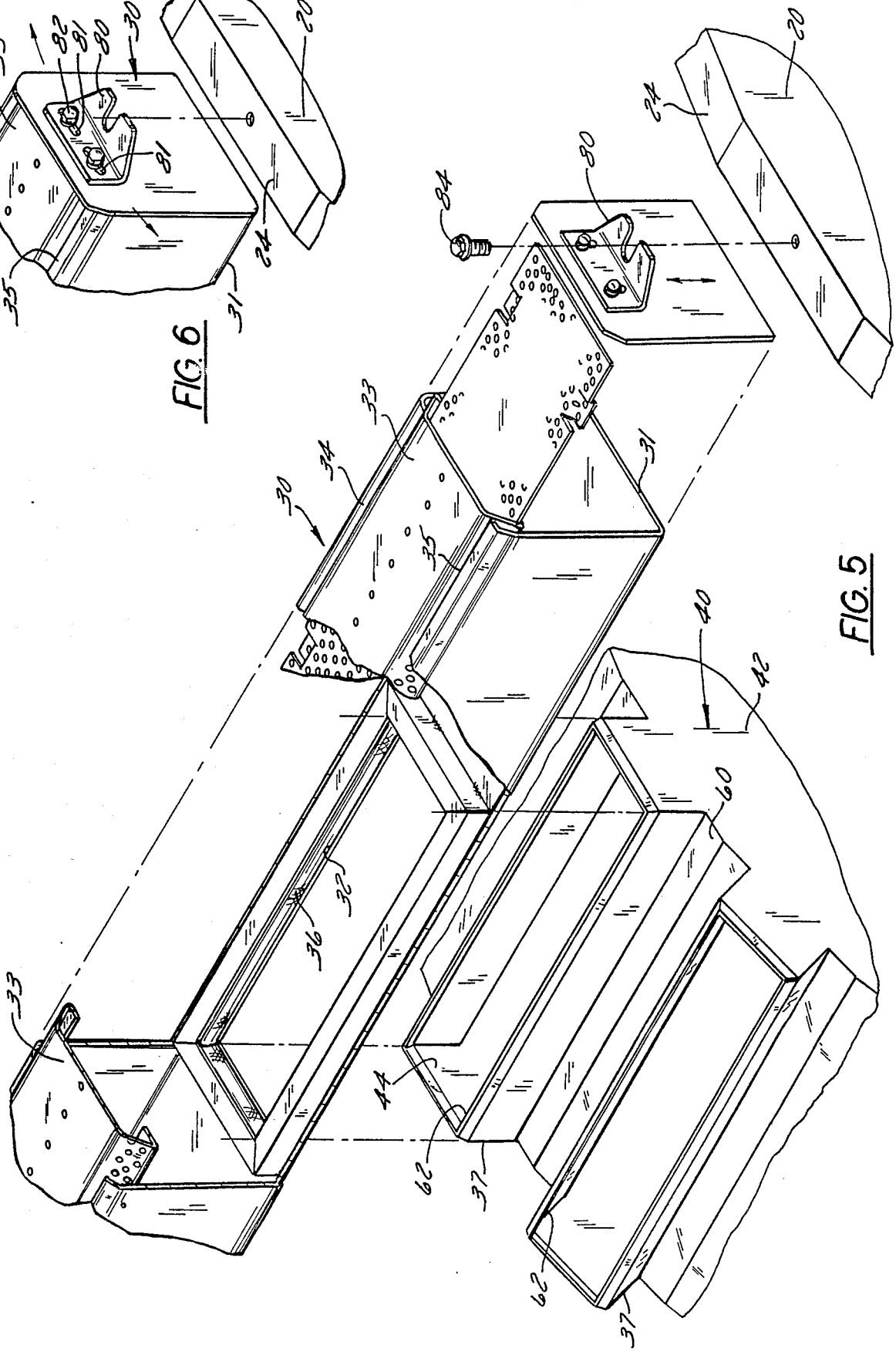
FIG. 5 is a fragmentary, exploded, perspective view of certain parts shown as broken away and showing an air bar and its connection to an enclosed chamber on which the bars are supported.
Figure 7:
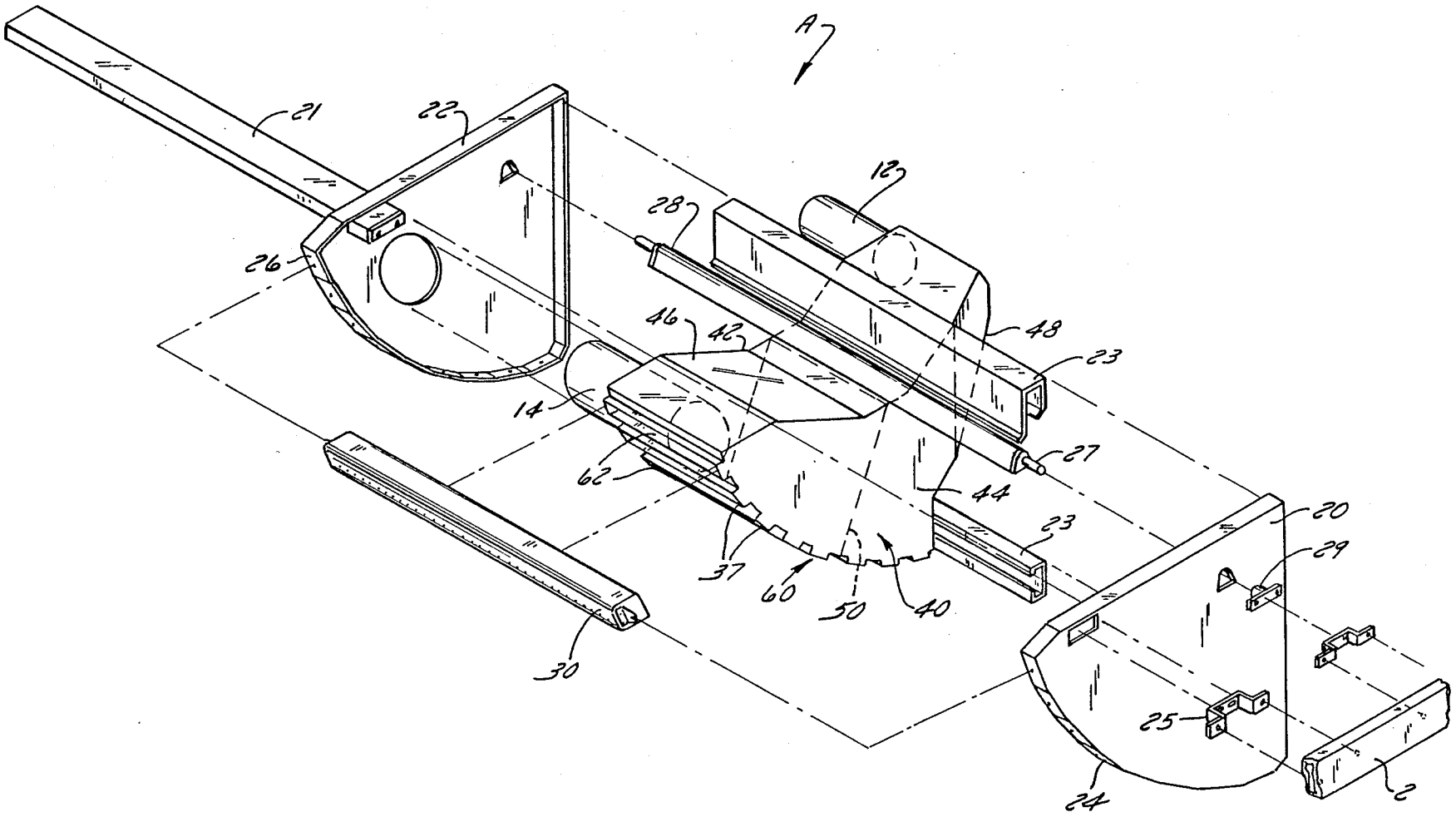
FIG. 7 is a perspective, exploded view of the generally hollow and enclosed chamber having an arcuate side on which the series of elongated, parallel air bars are mounted, the view being enlarged from the chambers shown in FIG. 1.

The apparatus A includes a pair of side walls 20, 22 (FIG. 7) which are fabricated from steel and each have a generally arcuate outer edge or surface in the form of a flange 24, 26, respectively, and to which flanges the double nozzle slot air bars 30, as shown clearly in FIG. 5, are attached at each end of the air bars. Steel fabricated braces 23 (FIGS. 3 and 7) are welded at their ends to side walls 20 and 22 to form a strong, rigid apparatus.

Figure 4:
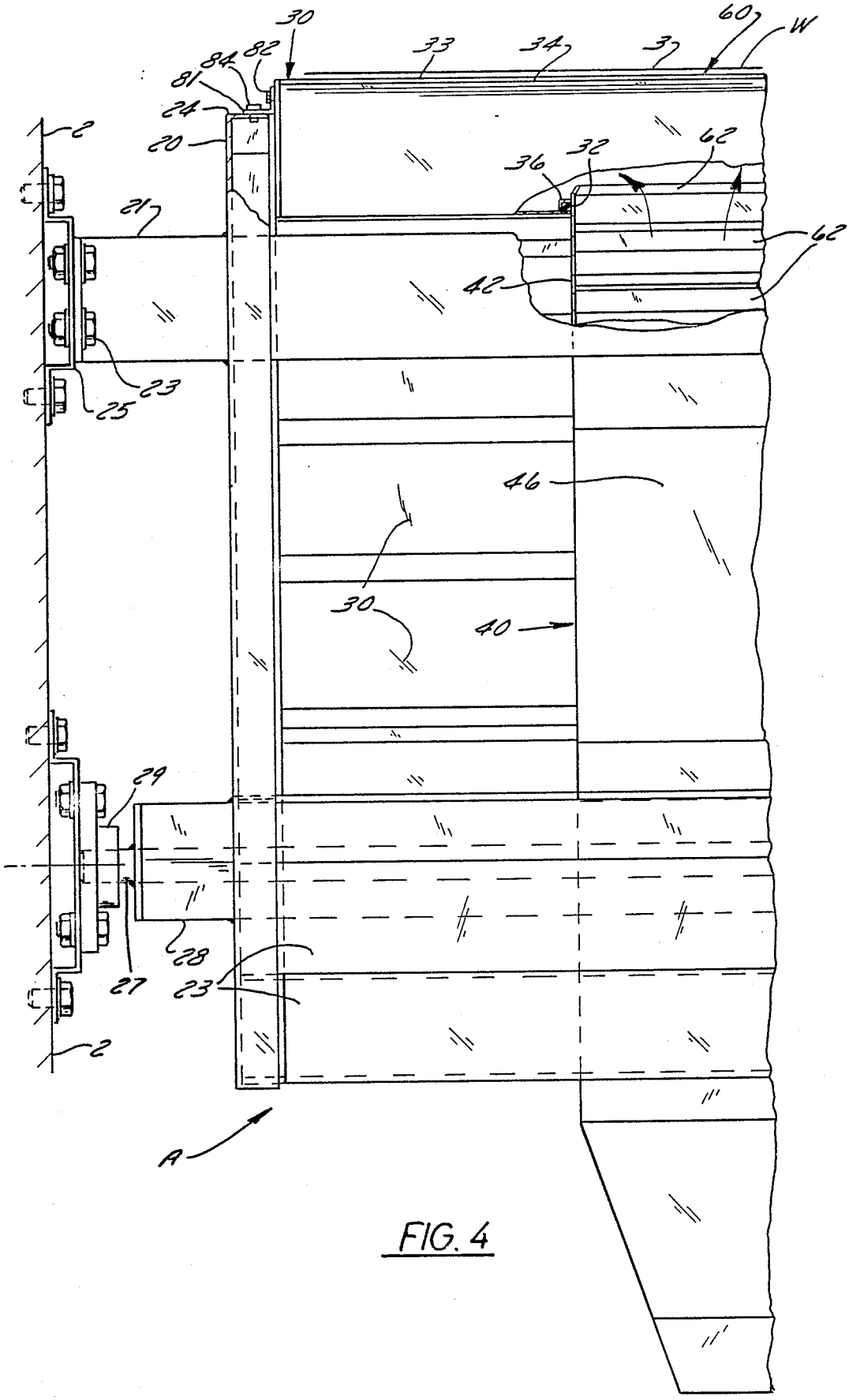
FIG. 4 is a plan view taken generally along line 4—4 in FIG. 3, with certain parts broken away or in section for the sake of clarity in the drawings, and only one half of the view being shown.

The apparatus A has means whereby it can be angularly adjusted initially for any given installation. This means takes the form of a transverse pivot bar 27 (FIG. 7) which is welded in a triangular (in cross section) shaped member 28 which in turn is inserted in and welded or otherwise fixed to the side walls 20, 22. The ends of the bar 27 are journaled in the bearings 29 (FIGS. 4 and 7) on frame 2 (FIG. 1). Thus, apparatus A can be set up initially as to its desired angular position. Once the above angular adjustment is made, the apparatus is locked in place by the bolt means 23 (FIG. 4) extending through brackets 25 on frame 2 and the ends of the transverse rectangular brace 21 (FIGS. 4 and 7) which is welded to side walls 20, 22.

The air bars themselves are conventional and may be of the type shown in U.S. patent application Ser. No. 61,328 filed June 11, 1987 and which issued on Nov. 22, 1988 as U.S. Pat. No. 4,785,986 assigned to an assignee with the prsent invention. It is believed sufficient to say that the air bars each have an inner surface 31 (FIG. 5) with a rectangular opening 32 therein, an outer surface 33 over which the web is floatingly suspended, and a pair of elongated nozzle slots 34 and 35, one along each outer edge of the air bar and through which pressurized air is discharged to floatingly support the traveling web in the known manner. The opening 32 in the inner side of the air bar has a provision for a flexible seal 36 located around its periphery and for sealing engagement with the neck portion 37 (FIGS. 5 and 7) of a generally hollow and enclosed chamber 40, to be described. The mounting of the air bars on the neck portion 37 and the tilting of the air bars thereon are shown and described in the copending U.S. application Ser. No. 61,327, filed June 11, 1987 now U.S. Pat. No. 4,787,547 which issued on Nov. 29, 1988.

More specifically the chamber 40 is fabricated from sheet steel and includes side members 42 and 44, upper wall 46 and a lower wall 48, all of which are welded together to form the chamber.

The interior of the hollow chamber 40 receives pressurized air from the ducts 12 and 14.

Figure 3:
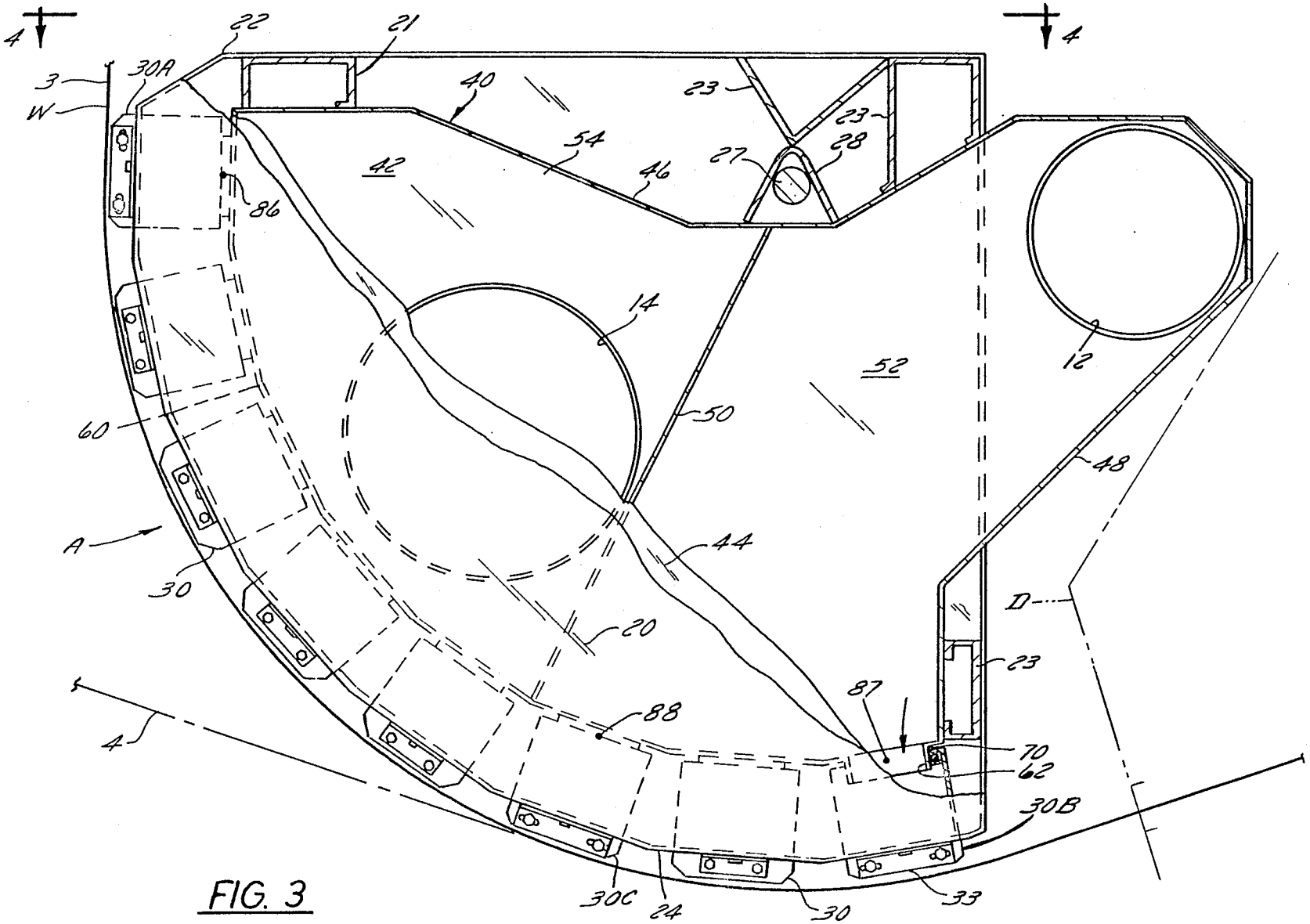
FIG. 3 is a vertical cross-sectional view taken along line 3—3 in FIG. 2, but on an enlarged scale and shown partially in cross section and with parts broken away from clarity.

A baffle 50 is located inside and across the entire interior of the chamber 40 and thus divides the enclosed chamber into a first compartment 52 and a second compartment 54. The duct 12 furnishes pressurized air from the fan to compartment 52 and the duct 14 furnishes pressurized air to the compartment 54. As will appear, when the entire arcuate surface of the apparatus A is to be utilized, both ducts 12 and 14 are used to supply pressurized air to the entire interior of the chamber. When it is desired to provide pressurized air only to chamber 52, the valve in duct 14 is closed and in this use of the apparatus, the web path 4 is shown in FIG. 3. When the web path 3 is utilized, the entire arcuate surface of apparatus A is utilized, as shown by web path 3 in FIGS. 1 and 9.

The generally hollow and enclosed chamber also has an arcuate side indicated generally by 60 which has a series of elongated, parallel openings 62 which are spaced apart circumferentially around the arcuate side. These openings are arranged in a transverse direction with respect to the direction of movement of the running web through the arucate paths. The series of elongated hollow air bars have their inner side sealingly engaged with the generally parallel openings, the outwardly extending neck portions 70 of the chamber 40 are inserted into the rectangular openings 32 of the air bars and are in sealing engagement therewith. The air bars 30 form an outwardly directed, arcuate array over which the running web passes. When the entire array of air bars are utilized in supporting the web, as when the web follows the path 3 as shown by the solid line in FIG. 1 or FIG. 9, the first air bar 30A (in respect to the direction of web travel) and also the last air bar 30B (in respect to the direction of web travel) are mounted so as to tilt about their longitudinal axis and thus change the position or angle of air attack against the web as shown by the dotted lines in FIG. 9. In other words, the bars 30A and 30B can be tilted in either a clockwise or counterclockwise direction, that is, depending on the operating conditions and circumstances, either one or both of the air bars may be tilted as required.

When only a portion of the total number of air bars are utilized to support the web, as for example when the web follows the path 4 as shown in FIG. 3, only the compartment 52 is utilized to pressurize the last three bars as shown in FIG. 3. In this use, the bar 30C (FIG. 3) is also mounted for longitudinal tilting because, under these circumstances, bar 30C constitutes the first air bar in respect to the direction of web travel.

Figure 6:
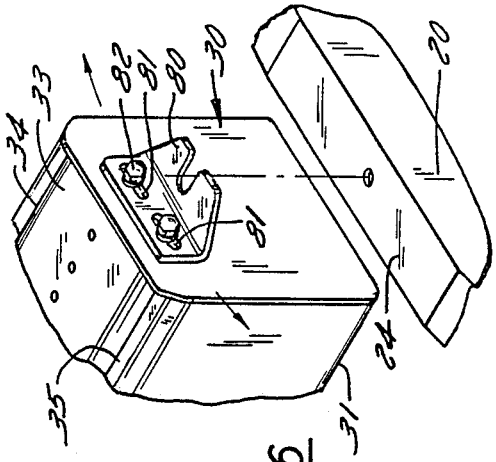
FIG. 6 is a fragmentary, perspective view of an end of the air bar and showing its means for tiltingly supporting certain of the air bars.
Figure 9:
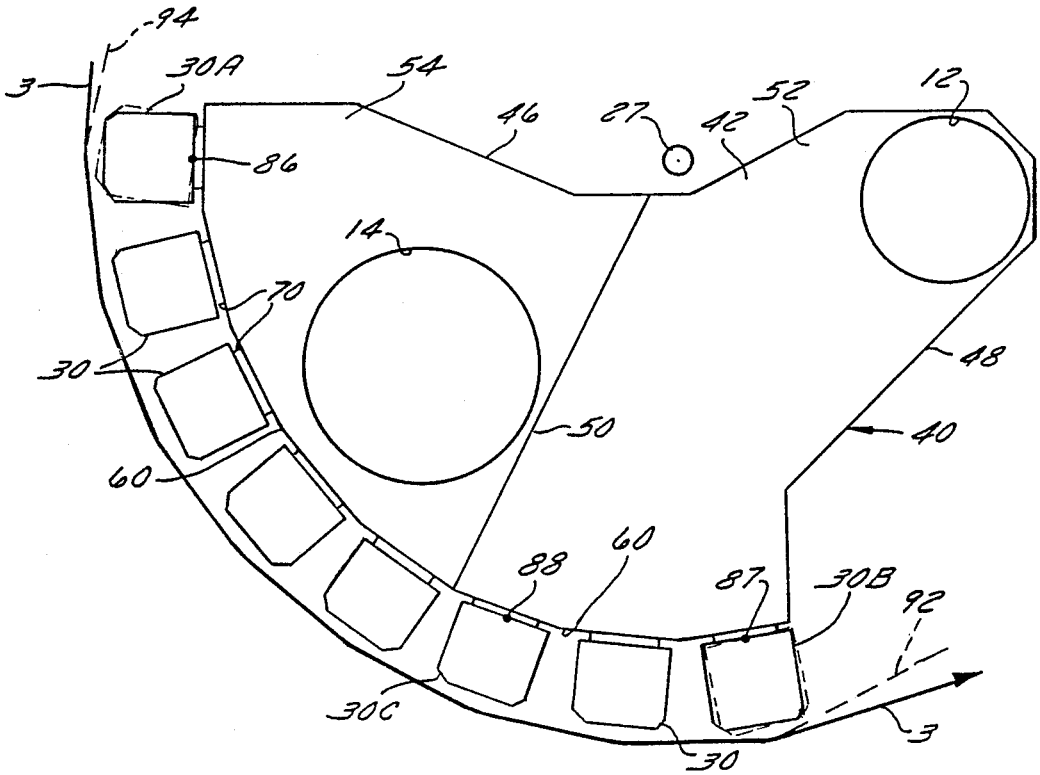
FIG. 9 is a view similar to FIG. 8 but showing the tilted position of both the first and last air bars (in respect to the direction of web travel) and when the web passes over the entire array of air bars.

The means for longitudinally tilting the air bars are shown in FIG. 6 wherein a mounting bracket 80, located on each end of the bars, has a pair of slots 81 through which the bolt means 82 extend to releasably and adjustably secure the air bar 30 to the bracket 80. The bracket 80, in turn, is secured by bolt means 84 to the flanges 24, 26 of the members 20, 22. When bolts 82 are loosened, the air bars 30A, 30B and 30C are pivoted about the points 86, 87 and 88, as shown in FIG. 9, swinging the bar and bolts 82 relative to the bracket, and the bolts 82 are then tightened. The construction shown enables the bars to maintain their sealing engagement with the enclosed chamber 40, regardless of their tilted position, due to the entry of the neck portions 37 (FIGS. 5 and 7) of member 40 into the rectangular openings 32 of the air bars and the sealing material 36 located therebetween.

Figure 8:
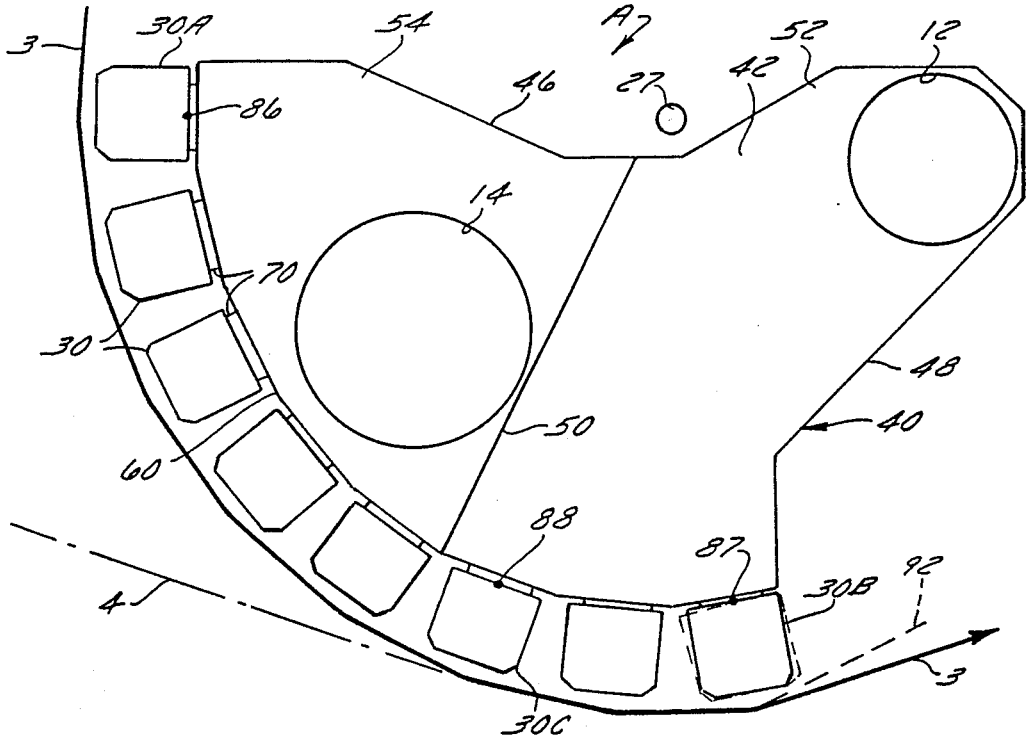
FIG. 8 is a side elevational view, more or less schematic in nature, and showing the generally hollow and enclosed chamber having an arcuate side on which a series of air bars are mounted in parallelism, and furthermore showing the last air bar in the array when in the tilted position.

It will be noted that bar 30B is common to both web paths, that is, regardless of which degree of wrap shown in FIG. 8 or FIG. 9 is used. Thus, bar 30B is common to both web paths in respect to being the last air bar in the web path. When only compartment 52 is utilized, that is, when the number of air bars utilized is less than the total, the air bar 30C is the first air bar in respect to the direction of web travel. Bar 30A is the first air bar in respect to the direction of web travel when the entire array of bars is utilized.

As mentioned, in operation when a Bill-Blade coater is utilized as shown in FIG. 1, the web must pass from it in a downward direction, more specifically at a 7° angle with the vertical. Then the web is turned by apparatus A so that it runs into the floater dryer D inclined upwardly at an angle of 15° with the horizontal. Thus, the web must be turned 112° by apparatus A and this 112° arc is equally divided into eight segments of 14° each, as shown. The air bars are mounted with their center (as measured in the web direction) located at the center of each of the arc segments and each air bar must floatingly support the web with a web wrap around the air bar face of 14°. With this arrangement, each air bar has the same load to carry and there is no back pressure and no web turning in the spaces between the individual air bars.

Referring to FIG. 9, the solid web line 3 indicates this ideal situation where the actual wrap and design wrap are identical and where there is no back pressure between the air bars. In this case, the web is generally straight (has no appreciable curvature) as it passes through the space 91 between the air bars. The web then assumes a curvature as it runs over the pressure pad of each air bar. With the air bars equally spaced as shown and with all of the bars having the same supply air pressure, the entire arcuate degree of web direction change occurs in equal amounts at each air bar. The relationship between web wrap, air bar cushion pressure, air bar position, etc. is the same for the first and last air bars as for those located therebetween.

These are some circumstances in which this arrangement is not quite satisfactory. The first circumstance is when the actual locations and orientations of the components in this particular environment shown, that is, the coater and flat dryer are not positioned in the field exactly as expected when the air drum was originally designed. Under this circumstance, the actual angle through which the web must be turned is somewhat different than that for which it was designed.

FIG. 8 illustrates the case where the air drum was designed and built to accommodate a web path shown by solid line 3-3, but due to a discrepancy between the original design information and the actual final placement of the adjacent components, the web must follow a path 3-92 instead of path 3-3. In particular, in the case illustrated by FIG. 8, the actual required web path involves a larger angle of web turning and thus a larger angle of wrap around the air drum than that for which the air drum was designed.

If the air drum is applied to such a situation with no modification of the air bar positions and orientations, the web will run perilously close to the leaving edge of air bar 30B. This, in turn, leads to an alteration of the air flow pattern between air bar 30B and the web. In particular, a substantial part of the air coming from the air bar slot at the web leaving edge of air bar 30B will flow across the air bar face toward the other slot. This flow pattern leads to a distortion of the web supporting air pressure cushion. The pressure becomes greater at the web entering edge and smaller at the web leaving edge, thus aggravating the web clearance problem.

However, if air bar 30B is tilted counterclockwise, as shown by the dashed outline of the air bar in FIG. 8, the air flow pattern, the web direction profiles of cushion pressure and web to air bar clearance all become symmetrical again and satisfactory web clearance can be maintained.

FIG. 9 illustrates a similar situation to that of FIG. 8, but the discrepancy between the web turning angle as required by the actual location and orientation of the surrounding equipment and that for which the air drum was designed and built is now greater. The required web path is now that shown by the dashed lines 92 and 94. In this case, the accommodation of the excess web wrap angle is shared in equal parts by both end air bars 30A and 30B. This is done by first rotating the entire air drum about the transverse pivot bar 27, in the initial set up of the array apparatus, so that the web approaches the face of air bar 30A with the same angle as it leaves the face of air bar 30B. Then air bar 30A is tilted clockwise and air bar 30B is tilted counterclockwise so as to maintain the symmetry of air flow, cushion pressure and web to air bar clearance profiles in the same way as described for the situation illustrated by FIG. 8 where only air bar 30B was tilted.

Another circumstance may arise where it is desirable to design the air drum so that a small amount of "back pressure" is maintained in the spaces between the individual air bars. This back pressure reduces the turning angle to be sustained by each air bar and then reduces the air pressure required. However, the first and last air bars in respect to the direction of web travel have a different flotation load to carry than that of the other air bars because there can be no back pressure in the space immediately adjacent to the end bars outside of the arcuate array. Under this circumstance, it is possible to have the ability to compensate for this discrepancy by angularly adjusting or tilting the first and last air bars.

Figure 10:
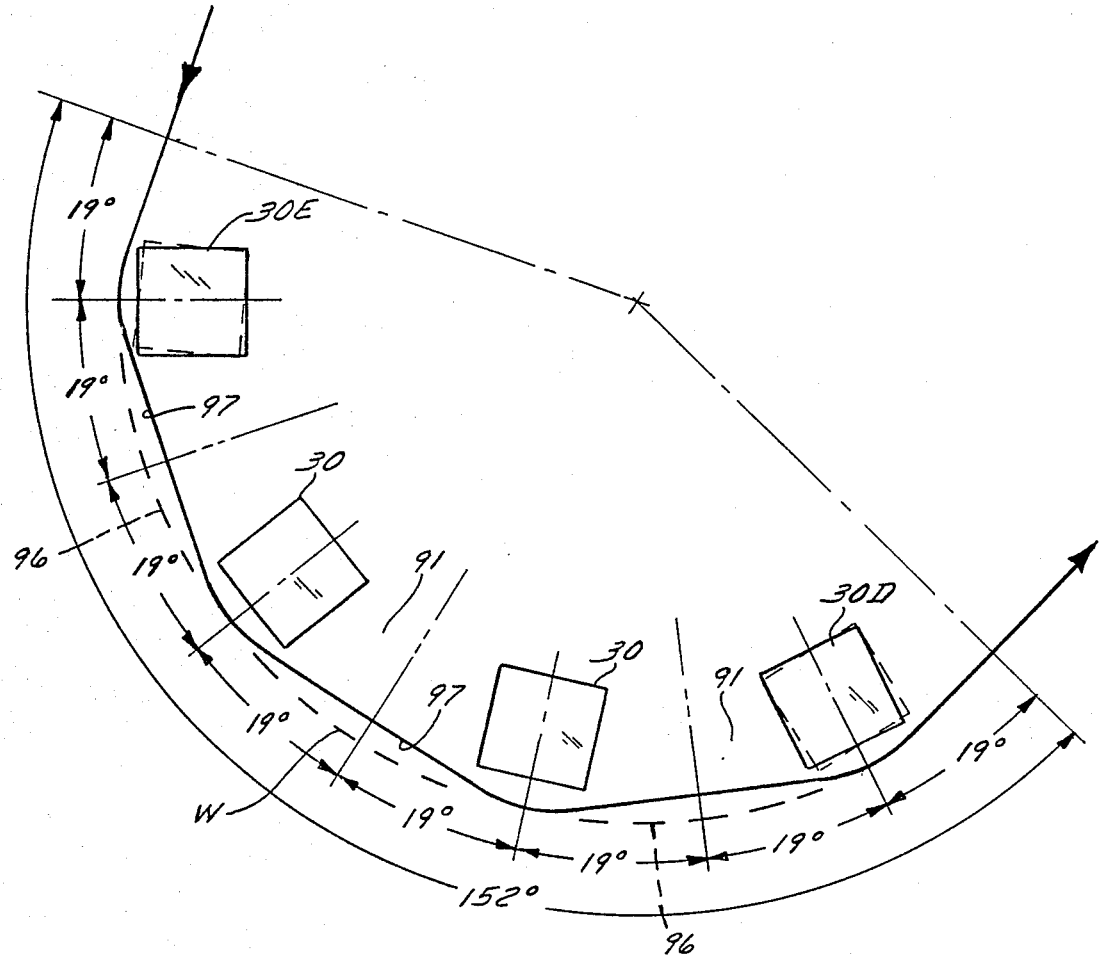
FIG. 10 is a view similar to FIGS. 8 and 9, but showing only four air bars in the array.

FIG. 10 shows an air bar array which includes only four air bars so that the curved portion 96 of the web path and the straight portion 97 of the web path may be shown exaggerated for clarity in the drawing. This arrangement illustrates what occurs when a back pressure is maintained in the spaces 91 between the air bars. In this case, the web path as shown by the broken line 96 is curved around the entire path (although generally with less curvature between the air bars than over the air bars). Since part of the web turning is done in the spaces 91 between air bars, less turning (and less angle of wrap) is required over the air bars themselves and less air bar supply pressure is needed. However, the web curvature diminishes abruptly beyond the outer edge of air bar 30E at the upstream side of the web direction and also may diminish beyond the outer edge of air bar 30D at the downstream side. This happens because the back pressure cannot be maintained outside either end of the arcuate array of air bars. With air bars 30D and 30E in their original positions (solid line position), the web will now have greater clearance from the inner edges of these air bars than it has from the outer edges, resulting in non-symmetrical, less stable cushion pressure profiles and flow patterns. As mentioned, these conditions can be corrected by tilting air bar 30D counterclockwise and air bar 30E clockwise as shown by the dotted outlines in FIG. 10.

Thus, by tilting the first and last air bars in the arcuate array, it as been found possible to accommodate a discrepancy between the actual and design values of angle of turn and also accommodate the discontinuity of web supporting pressure at the first and last air bars when there is back pressure maintained in the spaces between the air bars.

What is claimed is:

1. Apparatus for floatingly suspending a running web without contact and through an arcuate path, said apparatus including a generally hollow and enclosed chamber having an arcuate side with a series of elongated openings spaced apart circumferentially around the radially outer side of said arcuate side, said openings arranged generally in a transverse direction with respect to the direction of movement of said running web through said arcuate path; a series of elongated hollow air bars having an inner side directly and sealingly engaged with said openings, said bars each having an outer side, a pair of air nozzle slots in and along each of said outer sides of said air bar; means for providing pressurized air to said enclosed chamber, through said openings and then through said slots to floatingly support said running web; said bars thus forming an outwardly directed, arcuate array over which said running web passes; the last air bar in the array in respect to the direction of web travel over the array being adjustable about its longitudinal axis to thereby tilt the said last air bar and correct any non-symmetrical web-to-bar orientation.

2. The apparatus set forth in claim 1 including means for also adjustably mounting the first air bar in said array about its longitudinal axis, whereby when a back pressure of air is maintained in said enclosed chambers and between said air bars, a more stable cushion pressure profile and symmetrical web flow pattern is maintained.

3. A running web processing line of equipment including; a web treating machine from which the web exits selectively at two different locations and in a generally downward direction; a floater dryer through which the web eventually passes, and apparatus for floatingly suspending the running web through an arcuate path, said apparatus located in the web path between said machine and said dryer for directing said web selectively from either of said machine exits and through said arcuate path and into said dryer; said apparatus including a generally hollow and enclosed chamber having an arcuate side with a series of elongated openings spaced apart circumferentially around the radially outer side of said arcuate side, said openings arranged in a generally transverse direction with respect to the direction of movement of said running web through said arcuate path; a series of elongated hollow air bars having an inner side directly and sealingly engaged with said openings, said bars each having an outer side, a pair of air nozzle slots in and along each of said outer sides of said air bar; means for providing pressurized air to said enclosed chamber, through said openings and then through said slots to floatingly support said running web; said bars thus forming an outwardly directed, arcuate array over which said running web passes; the last air bar in the array in respect to the direction of web travel over the array being adjustable about its longitudinal axis to thereby tilt the said last air bar and correct any non-symmetrical web-to-bar orientation.

4. A line of equipment for processing a running web and including; a web treating machine from which the web exits selectively at two different locations and in a generally downward direction; a floater dryer through which the web eventually passes, and apparatus for floatingly suspending the running web through an arcuate path, said apparatus located in the web path between said machine and said dryer for directing said web selectively from either of said machine exits and through said arcuate path and into said dryer; said apparatus including a generally hollow and enclosed chamber having an arcuate side with a series of elongated openings spaced apart circumferentially around the radially outer side of said arcuate side, said openings arranged in a generally transverse direction with respect to the direction of movement of said running web through said arcuate path; a series of elongated hollow air bars having an inner side directly and sealingly engaged with said openings, said bars each having an outer side, a pair of air nozzle slots in and along each of said outer sides of said air bar; means for providing pressurized air to said enclosed chamber, through said openings and then through said slots to floatingly support said running web; said bars thus forming an outwardly directed, arcuate array over which said running web passes; the last air bar in the array in respect to the direction of web travel over the array having means for being adjustable about its longitudinal axis to thereby tilt the said last air bar and correct any non-symmetrical web-to-bar orientation adjacent said last air bar; and second means for also adjustably mounting the first air bar in said array about its longitudinal axis, whereby when a back pressure of air is maintained in said enclosed chambers and between said air bars, a more stable cushion pressure profile and symmetrical web flow pattern is maintained adjacent said first air bar.

5. A running web processing line of equipment including; a web treating machine from which the web exits selectively at two different locations and in a generally downward direction; a floater dryer through which the web eventually passes, and apparatus for floatingly suspending the running web through an arcuate path, said apparatus located in the web path between said machine and said dryer for directing said web selectively from either of said machine exits and through said arcuate path and into said dryer; said apparatus including a generally hollow and enclosed chamber having an arcuate side with a series of elongated openings spaced apart circumferentially around said arcuate side, said openings arranged in a generally transverse direction with respect to the direction of movement of said running web through said arcuate path; a series of elongated hollow air bars having an inner side sealingly engaged with said openings, said bars each having an outer side, a pair of air nozzle slots in and along each of said outer sides of said air bar; means for providing pressurized air to said enclosed chamber, through said openings and then through said slots to floatingly support said running web; said bars thus forming an outwardly directed, arcuate array over which said running web passes; and a baffle plate located within said chamber to divide said chamber into separate first and second compartments, each compartment connected with and serving pressurized air to a number of said air bars less than the total number of air bars, each compartment having a separate source of pressurized air fed therethrough; whereby only one of said compartments acts to float said web when said web is of a lesser degree of wrap around said array than the total wrap; the last air bar in the array in respect to the direction of web travel over the array being common to each compartment and having means for being adjustable about its longitudinal axis to thereby tilt the said last air bar and correct any non-symmetrical web-to-bar orientation.

6. The equipment set forth in claim 5 including means for tilting the first air bar in each compartment about its longitudinal axis.

7. The equipment as described in claim 5 including, adjustdable means for pivoting said apparatus about a transverse axis so as to initially adjust said apparatus angularly with respect to the web in setting up said line of equipment.

8. Apparatus for floatingly suspending a running web without contact and through an arcuate path, said apparatus including a generally hollow and enclosed chamber having an arcuate side with a series of elongated openings spaced apart circumferentially around said arcuate side, said openings arranged generally in a transverse direction with respect to the direction of movement of said running web through said arcuate path; a series of elongated hollow air bars having an inner side sealingly engaged with said openings, said bars each having an outer side, a pair of air nozzle slots in and along each of said outer sides of said air bar; means for providing pressurized air to said enclosed chamber, through said openings and then through said slots to floatingly support said running web; said bars thus forming an outwardly directed, arcuate array over which said running web passes; the last air bar in the array in respect to the direction of web travel over the array being adjustable about its longitudinal axis to thereby tilt the said last air bar and correct any non-symmetrical web-to-bar orientation, and a baffle plate located within said chamber to divide said chamber into separate first and second compartments, each compartment connected with and serving pressurized air to a number of said air bars less than the total number of air bars, each compartment having a separate source of pressurized air fed therethrough; whereby only one of said compartments acts to float said web when said web is of a lesser degree of wrap around said array than the total wrap.

9. The apparatus of claim 8 including valve means for each separate source of air to said compartments.

10. The apparatus as described in claim 8 including, adjustable means for pivoting said apparatus about a transverse axis so as to initially adjust said apparatus angularly with respect to the web.

* * * * *

UNITED STATES PATENT AND TRADEMARK OFFICE

CERTIFICATE OF CORRECTION

PATENT NO. : 4,837,946

DATED : June 13, 1989

INVENTOR(S) : Terry A. Hella & Paul H. Stibbe

It is certified that error appears in the above-identified patent and that said Letters Patent is hereby corrected as shown below:

Item (75) on the title page, "Jerry A. Hella" should be "Terry A. Hella".

Signed and Sealed this

Sixth Day of February, 1990

*Attest:*

JEFFREY M. SAMUELS

*Attesting Officer*

*Acting Commissioner of Patents and Trademarks*